United States Patent [19]

Gill, III

[11] 4,391,063

[45] Jul. 5, 1983

[54] BALLOON WITH SEALING DEVICE THEREFOR AND METHOD

[75] Inventor: H. Ross Gill, III, Ashland, Ohio

[73] Assignee: The National Latex Products Co., Ashland, Ohio

[21] Appl. No.: 275,858

[22] Filed: Jun. 22, 1981

[51] Int. Cl.[3] ..... A63H 3/06; B32B 15/14; B32B 15/20; B65D 63/02

[52] U.S. Cl. ..... 46/90; 24/20 R; 24/30.5 T; 156/227

[58] Field of Search ..... 46/87, 88, 89, 90; 24/16 R, 20 R, 30.5 T, 255 SL; 156/176, 201, 227, 269

[56] References Cited

U.S. PATENT DOCUMENTS

| | | | |
|---|---|---|---|
| 1,778,955 | 10/1930 | Morrill | 24/30.5 T |
| 1,905,392 | 4/1933 | Freydberg | 24/20 R |
| 2,832,115 | 4/1958 | Schindler | 24/20 R |
| 2,973,597 | 3/1961 | Powell | 24/30.5 T |
| 3,236,005 | 2/1966 | Tomosy et al. | 46/90 |
| 3,409,948 | 11/1968 | Goodwin | 24/30.5 T |
| 3,978,555 | 9/1976 | Weisenthal | 24/255 SL |

FOREIGN PATENT DOCUMENTS

| | | | |
|---|---|---|---|
| 551494 | 1/1958 | Canada | 156/201 |
| 713309 | 8/1954 | United Kingdom | 46/90 |

*Primary Examiner*—F. Barry Shay

*Attorney, Agent, or Firm*—Baldwin, Egan, Walling & Fetzer

[57] ABSTRACT

A sealing device for a balloon comprising a thin deformable strip of foil attached to a flexible balloon retainer line, with the strip being of a thickness that it may be readily wound about the neck of the inflated balloon by one's fingers and when in such position being self sustained in such wound condition, to prevent the escape of air or gas through the balloon neck portion, while at the same time attaching the retainer line to the balloon. The foil strip is coated on one side with pressure-sensitive adhesive, one end of the line laid lengthwise on the adhesive and the strip folded to simultaneously form the sealing device and attach the line. The foil may have a thickness of approximately 0.001 to 0.002 inches.

10 Claims, 6 Drawing Figures

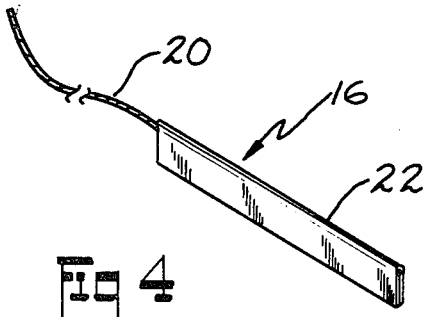
Fig 4
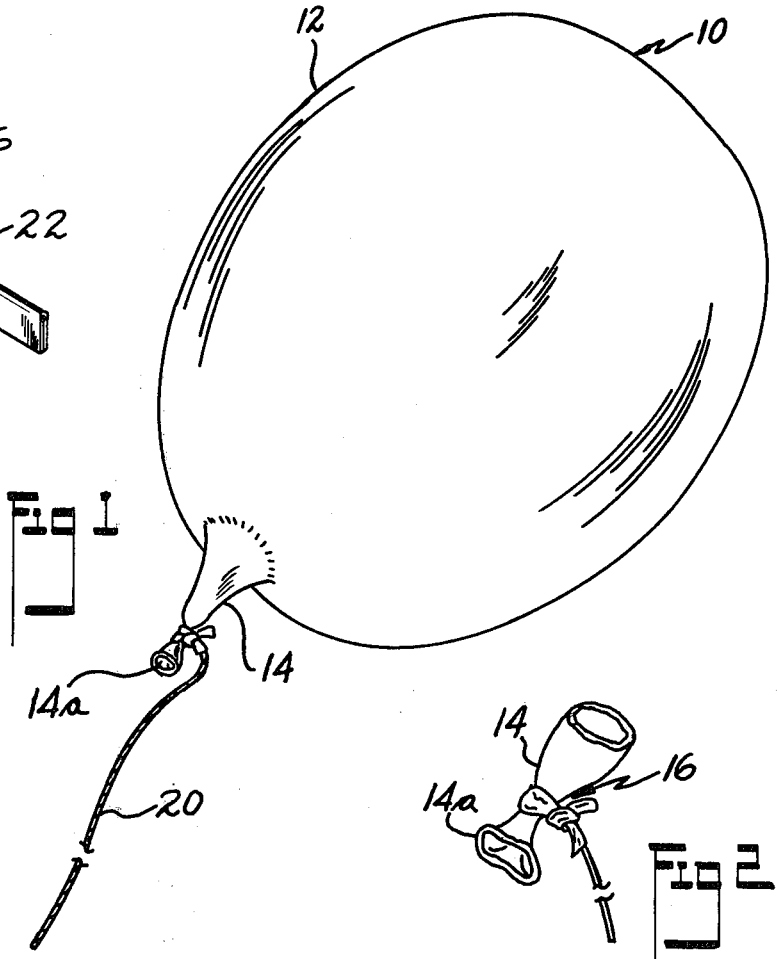
Fig 1
Fig 2
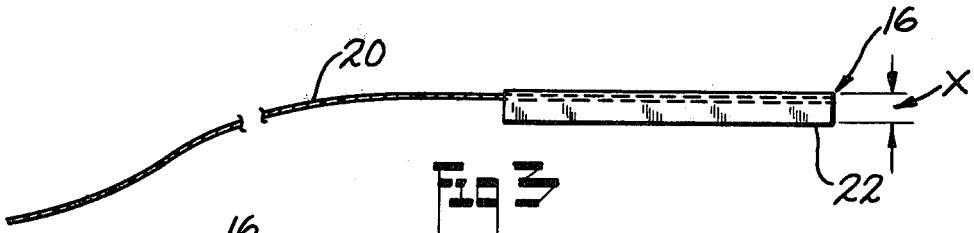
Fig 3
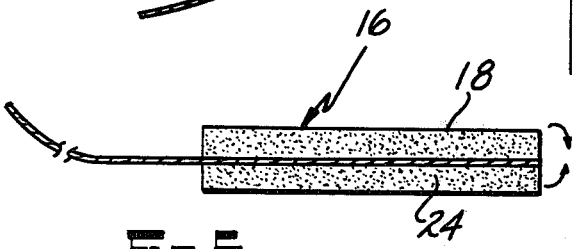
Fig 5
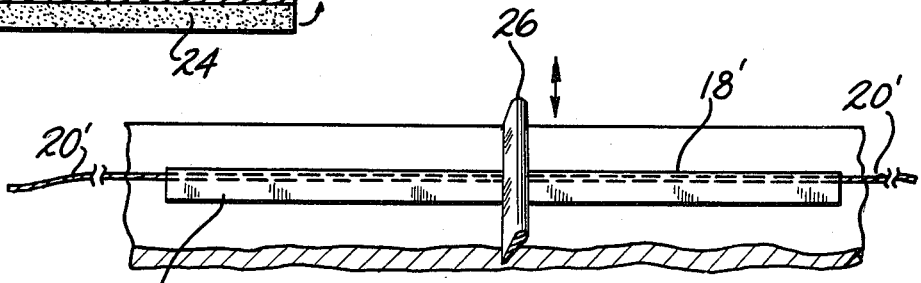
Fig 6

BALLOON WITH SEALING DEVICE THEREFOR AND METHOD

This invention relates in general to a sealing device for sealing toy balloons, and more particularly to a sealing device which comprises a deformable strip of foil attached to a flexible balloon retaining line, and wherein the strip is of such thickness and deformability that it may be readily wound about the neck of an inflated balloon by one's fingers, and, will be self sustaining in such wound condition, for sealing the balloon against the escape of air or gas, while at the same time attaching the retainer line to the balloon.

BACKGROUND OF THE INVENTION

Many types of closures for toy balloons are known in the art. U.S. Pat. Nos. 3,094,807 dated June 25, 1963 to Dorman; 3,236,005 dated Feb. 22, 1966 to Tomosy et al; and 3,783,551 dated Jan. 8, 1974, to Allison et al are exemplary of known prior art closures for toy balloons.

U.S. Pat. No. 3,094,807 disclosures a spring clip and string combination arrangement for sealing the neck of a balloon.

U.S. Pat. No. 3,236,005 discloses a foil sleeve which is deformable into sealing relation on the neck of the balloon, for preventing the escape of air through the neck portion of the balloon.

U.S. Pat. No. 3,783,551 discloses an apertured disc which pinches together a doubled over section of the neck of an inflated balloon, for sealing the balloon, and with there being a string attached to the balloon neck by the disc.

While these prior art arrangements are generally effective for sealing the neck of the balloon, they are relatively complex as compared to the present arrangement and are generally more costly, and/or require greater dexterity to fasten the device to the neck of an inflated balloon.

SUMMARY OF THE INVENTION

The present invention provides a sealing device for a balloon comprising a thin deformable strip of foil attached to a flexible balloon retainer line, with the strip being of a thickness that it may be readily wound about the neck of an inflated balloon by one's fingers and when in such position being self sustained in such wound condition, to prevent the escape of air or gas through the balloon neck portion, while at the same time attaching the retainer line to the balloon. A method of forming the sealing device is also disclosed.

Accordingly, an object of the invention is to provide a novel sealing device for a balloon, which is relatively inexpensive, and yet which will effectively seal the neck of the balloon against the escape of air or gas therefrom, while at the same time attaching a balloon retainer line to the neck.

Another object of the invention is to provide a sealing device of the aforementioned type which may be expeditiously and rapidly attached to the neck of the balloon, or released from the neck of the balloon.

A still further object is to provide a sealing device of the aforementioned type to which is formed from a deformable strip of foil attached to a flexible balloon retainer line, and with the foil strip being adapted to be twisted or wrapped about the neck of the inflated balloon for sealing the latter, while at the same time effectively attaching the retainer line to the balloon.

A still further object of the invention is to provide a balloon with a novel sealing arrangement secured thereto with the sealing arrangement comprising a deformable strip of foil which is attached to one end of a flexible balloon retainer line, with the foil being of a thickness that can be deformed or twisted by one's fingers about the neck of the inflated balloon, and which is of such nature that it is self sustaining in such deformed or twisted condition, for sealing the neck of the balloon against the escape of gas therefrom, and which is operable to effectively attach the retainer line to the inflated balloon.

A still further object is to provide a novel method for forming the sealing device aforedescribed.

Other objects and advantages of the invention will be apparent from the following description taken in conjunction with the accompanying drawings wherein:

BRIEF DESCRIPTION OF THE DRAWINGS

FIG. 1 is a perspective partially broken view of an inflated balloon with the sealing device attached thereto.

FIG. 2 is an enlarged, frangmentary portion of the neck of the balloon shown in FIG. 1, illustrating the sealing device twisted about the neck to seal the latter.

FIG. 3 is an elevational view of the sealing device and attached retainer line, the latter being broken.

FIG. 4 is a perspective view of the sealing device and attached retainer line illustrated in FIG. 3.

FIG. 5 is a partially broken, plan view involving the formation of the sealing device, showing the foil strip coated on one side thereof with a layer of adhesive, with the retainer line extending longitudinally of the foil prior to the foil being folded upon itself to secure the foil thicknesses to one another and to the retainer line.

FIG. 6 is a generally perspective illustration of another method which may be involved in formation of the balloon sealing device, and more particularly formation of a pair of the sealing devices at the same time.

DETAILED DESCRIPTION OF THE PREFERRED EMBODIMENTS

Referring now again to the drawings, FIG. 1 illustrates a conventional toy balloon 10, comprising a body 12, and a neck portion 14, with such neck portion terminating in an thickened edge or rim **14*a***, and as is conventional in articles of this type.

A sealing device 16 is adapted for wrapping or being twisted by one's fingers about the neck of the inflated balloon, is provided for preventing escape of the air or gas through the neck of the inflated balloon. Sealing device 16 comprises a section of foil 18 (FIG. 5) which is of such thickness that it may be readily twisted or wrapped about the neck of the inflated balloon, and when in such condition, will be self-sustaining in preventing the escape of the gas or air through the neck portion of the balloon. Attached to the foil section is a flexible balloon retainer line 20, such as cotton string or any other suitable material, for maintaining the balloon captive. It will be seen therefore, that upon twisting or wrapping the foil section of the sealing device 16 about the neck of the balloon, the retainer line is automatically coupled to the balloon.

The foil section in the embodiment illustrated, comprises a strip of aluminum foil which is folded upon itself (FIG. 5) to form a double wall thickness strip 22 (FIGS. 3 and 4). The foil section 18 has a layer of adhesive 24 (FIG. 5) on one side thereon, and when it is folded upon itself as illustrated by the arcuate arrows in FIG. 5, the adhesive which is preferably a pressure sensitive adhesive, secures the folded over wall sections to one another as well as securing and clasping the retainer line 20 therebetween. It will be seen therefore that the adhered folded over foil thicknesses, and the associated adhesive 24, securely hold the retainer line to the foil strip, but does not adversely affect the flexibility or deformability of the double wall thickness strip 22 of foil.

The foil section 18 prior to its being folded over, preferably has a wall thickness in the range of approximately 0.001 of an inch, to 0.002 of an inch, which has been found to be a suitable foil wall thickness for forming the foil section 22, and wherein the latter can be readily twisted or deformed by one's fingers about the neck of an inflated balloon, while still being adequate to be self-sustaining in such twisted or wrapped around condition, so as to prevent the escape of air or gas from the balloon interior.

A suitable length of foil strip 22 for convenient or expeditious wrapping or twisting about the neck of an inflated balloon has been found to be approximately 2¼ inches longitudinal length, and approximately 2/10 inch in transverse dimension as viewed for instance in FIG. 3. However, it will be understood that the aforementioned dimensions are merely exemplary of a preferred embodiment, and are not critical to the operation of the sealing device of the invention.

FIG. 6 shows an alternate method of forming the sealing device by providing a foil section 18' which is twice the longitudinal length desired for the foil section, and then the balloon retainer line 20' is laid longitudinally of the open section 18' prior to the folding over of the wall sections thereof, with the retainer line 20' extending from both ends of the finalized elongated foil strip 22' and as shown in FIG. 6. After the foil section is folded over into the double wall thickness of strip 22', and thus securing the retainer line 20' interiorly of the folded foil section, the latter can be severed as by means of a cutter blade 26, for cutting the strip 22' and attached retainer line 20' into two separate pieces, thereby providing a pair of sealing devices. The severing can be conveniently accomplished when the foil strip 22' is supported or rests on a support 28.

While aluminum foil has been identified as the preferred material for strip 22 or 22', other types of foils having generally similar characteristics might also be utilized.

From the foregoing discussion and the accompanying drawings, it will be seen that the invention provides a novel sealing device for toy balloons which comprises a relatively thin, deformable strip of foil attached to a flexible balloon retainer line, with the foil strip being of a thickness that it may be readily twisted or wrapped by one's fingers about the neck of an inflated balloon, for expeditiously sealing the latter, and at the same time attaching the retainer line to the balloon, and which strip is self-sustaining in such wrapped around condition so as to prevent the escape of air or gas through the neck portion of the balloon. The invention also provides a novel method of forming a sealing device for a balloon, as well as a novel balloon-sealing device combination, and which sealing device may be just as readily disassembled from the balloon as it is assembled therewith.

The terms and expressions which have been used are used as terms of description and not of limitation, and there is no intention in the use of such terms and expressions of excluding any equivalents of any of the features shown and described or portions thereof, but it is recognized that various modifications are possible within the scope of the invention claimed.

What is claimed is:

1. A combined sealing device and flexible retainer line for a toy balloon, comprising a double wall thickness strip of deformable but self-sustaining foil with the retainer line being non-self-sustaining, as for example string, disposed intermediate the walls of said double wall thickness foil strip, and extending for substantially the full length of said strip as well as extending a predetermined amount of substantially greater length as compared to the length of said strip from an end of said strip, for providing for gripping of the line by the balloon user, said walls of said strip being secured to one another by an adhesive disposed between the same, said adhesive also securing said line to said strip walls intermediate thereof, the wall thickness of said foil being in the range of approximately 0.001 of an inch to 0.002 of an inch, said strip being readily wound or twisted about the neck of an inflated balloon by one's fingers and being self-sustaining in said wound or twisted condition for expeditiously sealing the balloon against the escape of pressure from within the balloon's interior while at the same securely attaching the retainer line to the balloon, said combined sealing device and attached retainer line being readily removable from the balloon neck by unwinding or untwisting said strip.

2. A combined sealing device and flexible retainer line in accordance with claim 1 wherein said strip comprises an elongated member of foil which is coated on one side thereof with a pressure sensitive adhesive forming said adhesive of claim 1, said foil member being folded upon itself and clasping said retainer line therein intermediate said walls, said retainer line being oriented adjacent the folded edge of said strip to form a lengthwise extending rib therealong.

3. A combined sealing device and flexible retainer line in accordance with claim 1 wherein said elongated strip member is aluminum foil.

4. A combined sealing device and flexible retainer line in accordance with claim 1 wherein said adhesive is pressure sensitive and secures said double wall thickness together and to said retainer line, said strip being approximately 2¼ inches long and approximately 0.2 of an inch wide.

5. In combination a toy balloon comprising an inflatable resilient body portion and a neck portion connected to said body portion, and a combined sealing device and flexible retainer line wound or twisted about the neck portion and carried thereby, said sealing device comprising a relatively thin deformable but self-sustaining strip of foil of double wall thickness with said flexible retainer line being non-self-sustaining, as for example string, attached to said strip intermediate the walls of said strip, said line extending for substantially the full length of said strip as well as extending a predetermined amount of substantially greater length as compared to the length of said strip from an end of said strip, for providing for gripping of the line by the balloon user, said walls of said strip being secured to one another by an adhesive disposed between the same, with said adhesive also securing said line to said strip walls intermediate thereof, the wall thickness of each of said strip walls being in the range of approximately 0.001 of an inch to 0.002 of an inch, said strip encircling the exterior of said neck portion and being readily wound or twisted about the neck portion of the inflated balloon by one's fingers, and being self-sustaining in said wound or twisted condition and preventing the escape of air through said neck portion, while securing said flexible retainer line to said balloon, said combined sealing device and retainer line being readily removable from said balloon by unwinding or untwisting said strip from about said neck.

6. The combination in accordance with claim 5 wherein said strip comprises an elongated member of aluminum foil which is coated on one side thereof with a pressure sensitive adhesive forming said adhesive, said member being folded upon itself, and clasping said retainer line therein intermediate said walls and adjacent the folded edge of said strip, to form a lengthwise extending deformable rib therealong.

7. The combination in accordance with claim 6 wherein said strip is approximately 2¼ inches long and approximately 0.2 of an inch wide.

8. A method of forming a combined sealing device and flexible retainer line for a toy balloon comprising, providing a relatively thin deformable but self-sustaining elongated section of foil having on one side thereof a coating of adhesive, the wall thickness of said foil being in the range of approximately 0.001 of an inch to 0.002 of an inch, laying a non-self-sustaining retainer line such as a string or the like longitudinally of said foil section for substantially the full length of said section with the line extending a predetermined amount of substantially greater length as compared to the length of said section from an end of said section, and then folding said foil section upon itself to form an elongated foil strip of double wall thickness which clasps said retainer line therein, with said adhesive securing the double wall thickness of the foil together and to the intermediate retainer line, said strip being self-sustaining but being readily wound or twisted about the neck of an inflated toy balloon for expeditiously sealing the latter against the escape of pressure from within the balloon and at the same time being operable to securely attach the retainer line to the balloon, with said combined sealing device and attached retainer line being readily removable from the balloon by unwinding or untwisting the strip from about the neck of the balloon.

9. A method in accordance with claim 8 including the step of providing a foil section of twice the length desired for the finalized length of said strip, and laying the retainer line on said foil section longitudinally thereof so as to extend beyond both ends thereof said predetermined amount, folding the double length section upon itself to secure the section walls to one another and to said retainer line and provide an elongated strip of foil with the retainer line extending from both ends thereof, and then cutting said elongated foil strip into at least two parts to provide a pair of said sealing devices.

10. A method in accordance with claim 8 wherein said foil section is aluminum foil with said adhesive being a pressure sensitive adhesive, and securing said double wall thickness of the foil together by pressure folding of the adhesive coated sides of the foil wall thicknesses together against one another and said retainer line to form said double wall thickness foil strip, said strip being of a length of approximately 2¼ inches and being approximately 0.2 of an inch wide.

* * * * *